US011162250B2

(12) United States Patent
Shinde

(10) Patent No.: US 11,162,250 B2
(45) Date of Patent: Nov. 2, 2021

(54) DRAIN VALVE ASSEMBLY FOR A BASIN

(71) Applicant: THE BOEING COMPANY, Chicago, IL (US)

(72) Inventor: Jagdish Shinde, Bangalore (IN)

(73) Assignee: THE BOEING COMPANY, Chicago, IL (US)

( * ) Notice: Subject to any disclaimer, the term of this patent is extended or adjusted under 35 U.S.C. 154(b) by 59 days.

(21) Appl. No.: 16/742,325

(22) Filed: Jan. 14, 2020

(65) Prior Publication Data

US 2021/0214928 A1 Jul. 15, 2021

(51) Int. Cl.
*E03C 1/23* (2006.01)

(52) U.S. Cl.
CPC ..... *E03C 1/2302* (2013.01)

(58) Field of Classification Search
CPC ..... E03C 1/2302; E03C 1/2304; E03C 1/23
USPC ..... 4/688–691, 295
See application file for complete search history.

(56) References Cited

U.S. PATENT DOCUMENTS

| | | | | |
|---|---|---|---|---|
| 1,418,664 | A | 6/1922 | McNeil | |
| 1,857,054 | A * | 5/1932 | Luppes | E03C 1/2302 4/688 |
| 2,324,946 | A | 7/1943 | Molloy | |
| 2,397,269 | A | 3/1946 | Kelly | |
| 2,576,414 | A | 11/1951 | Peterson | |
| 2,864,398 | A | 12/1958 | Gzeen | |
| 2,988,110 | A | 6/1961 | Thomas | |
| 4,475,573 | A | 10/1984 | Hindman | |
| 5,660,208 | A | 8/1997 | Tres Casas | |
| 6,154,898 | A * | 12/2000 | Ball | E03C 1/232 4/689 |
| 6,234,209 | B1 | 5/2001 | Viegener | |
| 7,694,935 | B2 | 4/2010 | Wang | |
| 8,707,983 | B1 | 4/2014 | Chen | |
| 10,233,622 | B2 * | 3/2019 | Ball | E03C 1/2302 |
| 2009/0038686 | A1 | 2/2009 | Lin | |

OTHER PUBLICATIONS

Non-Final Office Action for U.S. Appl. No. 16/742,267 dated Jan. 7, 2021.
Non-Final Office Action for U.S. Appl. No. 16/741,975 dated Apr. 27, 2021.
Final Office Action for U.S. Appl. No. 16/742,267 dated Jun. 4, 2021.

* cited by examiner

*Primary Examiner* — Tuan N Nguyen
(74) *Attorney, Agent, or Firm* — Marshall, Gerstein & Borun LLP

(57) ABSTRACT

Drain valve assembly for a basin includes a drain having a sidewall, which defines a first opening in fluid communication with the basin and with a first portion of the drain. Sidewall includes wall formation positioned within the drain which extends across the first opening separating the first portion of the drain from a second portion of the drain. First portion of the wall formation extends in a first direction away from the basin and defines an outlet opening which extends through the first portion. Plug member is aligned with the outlet opening and movable from a first position with the plug member abutting the first portion and closing the outlet opening and to a second position wherein the plug member is positioned spaced apart from first portion placing the outlet opening in an open position providing fluid communication between the first portion and the second portion of the drain.

20 Claims, 8 Drawing Sheets

DRAIN VALVE ASSEMBLY FOR A BASIN

FIELD

This disclosure relates to a drain valve and more particularly to a drain valve for a basin.

BACKGROUND

Drain valve assemblies provide convenience to the user of a basin. The drain valve assembly allows the user to open or close a drain outlet without the user having to place their hands into the basin or to grasp a drain stopper in manipulating the drain stopper between open and closed blocked positions with respect to the drain outlet.

A drain valve assembly has a knob positioned near a faucet wherein the knob is connected to a first rod. The first rod extends downwardly with respect to the faucet and is connected to a first end portion of a second rod. The second rod extends transversely relative to the first rod. The second rod extends toward the drain of the basin and extends through an opening defined by a lateral extension of the drain such that a second portion of the second rod extends within the lateral extension of the drain and comes in contact with a drain stopper. In a default position, the drain stopper is in a closed position relative to the drain. In addition, a tension spring has a first end of the tension spring secured to a fixed item such as the counter that supports the basin, for example, and the tension spring extends toward the second rod and secures to the first end portion of the second rod.

Thus, when a user pushes down on the knob the first rod moves downward moving the first end portion of the second rod in a downward direction. With the first end portion of the second rod moving in the downward direction and with the second rod abutting a bottom of the opening of the lateral extension of the drain, the bottom of the opening acts as a pivot for the second rod causing the second end portion of the second rod to move upwardly. The second portion of the second rod pushes the drain stopper in an upward direction opening the drain. At the same time the drain stopper moves in the upward direction, the downward movement of the first rod lengthens the tension spring placing an upward tension force on the first end portion of the second rod.

With the drain in the open position the contents of the basin drains through the drain. With the contents of the basin removed, the user removes the downward force the user had placed on the knob and the tension spring, which contains a tension force, moves the first end portion of the second rod in an upward direction. Second rod pivots on an edge of the opening of the lateral extension of the drain and the second end portion of the second rod pivots downward lowering the drain stopper to a closed position with respect to the drain.

In this construction, first and second rods are mounted to one another in a side by side relationship permitting the second rod to rotate relative to the first rod with the first rod moved in a downward direction and upward direction. The downward force applied by the user on the first rod and an upward force applied to the first rod by the tension spring both apply a torque on the connection between the first and second rods. The connection between first and second rods is required to be robust so as to encounter this repeated exposure to torque and requires time for installation of the connection and contributes weight to the drain valve assembly. The repeated application of force and torque to the connection results in demand for inspection, maintenance and repair of the connection. In addition, the tension spring which extends between, for example, the counter that supports the basin and the second rod, requires time for installation and places an additional weight demand to the drain valve assembly.

There is a need for an simple and an effective drain valve assembly which has less parts and weight to the assembly and which is easy to install and which has lesser demands with respect to installation, inspection and repair.

SUMMARY

An example includes a drain valve assembly for a basin which includes a drain having a sidewall, which defines a first opening, wherein the first opening is in fluid communication with the basin and with a first portion of the drain. The sidewall includes a wall formation positioned within the drain which extends across the first opening separating the first portion of the drain from a second portion of the drain. A first portion of the wall formation extends in a first direction away from the basin and defines an outlet opening which extends through the first portion. The drain valve assembly further includes a plug member aligned with the outlet opening and movable from a first position with the plug member abutting the first portion and closing the outlet opening and to a second position wherein the plug member is positioned spaced apart from the first portion placing the outlet opening in an open position providing fluid communication between the first portion and the second portion of the drain.

An example includes a method for installing a drain valve assembly to a basin, comprising: positioning a drain aligned with an opening in the basin with the drain having a sidewall, which defines a first opening, wherein the first opening is in fluid communication with the basin and with a first portion of the drain. The sidewall includes a wall formation positioned within the drain which extends across the opening separating the first portion of the drain from a second portion of the drain. A first portion of the wall formation extends in a direction away from the basin and defines an outlet opening which extends through the first portion. The method of installing further includes a plug member aligned with the outlet opening and movable from a first position with the plug member abutting the first portion and closing the outlet opening and to a second position wherein the plug member is positioned spaced apart from the first portion placing the outlet opening in an open position providing fluid communication between the first portion and the second portion of the drain.

The features, functions, and advantages that have been discussed can be achieved independently in various embodiments or may be combined in yet other embodiments further details of which can be seen with reference to the following description and drawings.

DESCRIPTION

Figure 6:
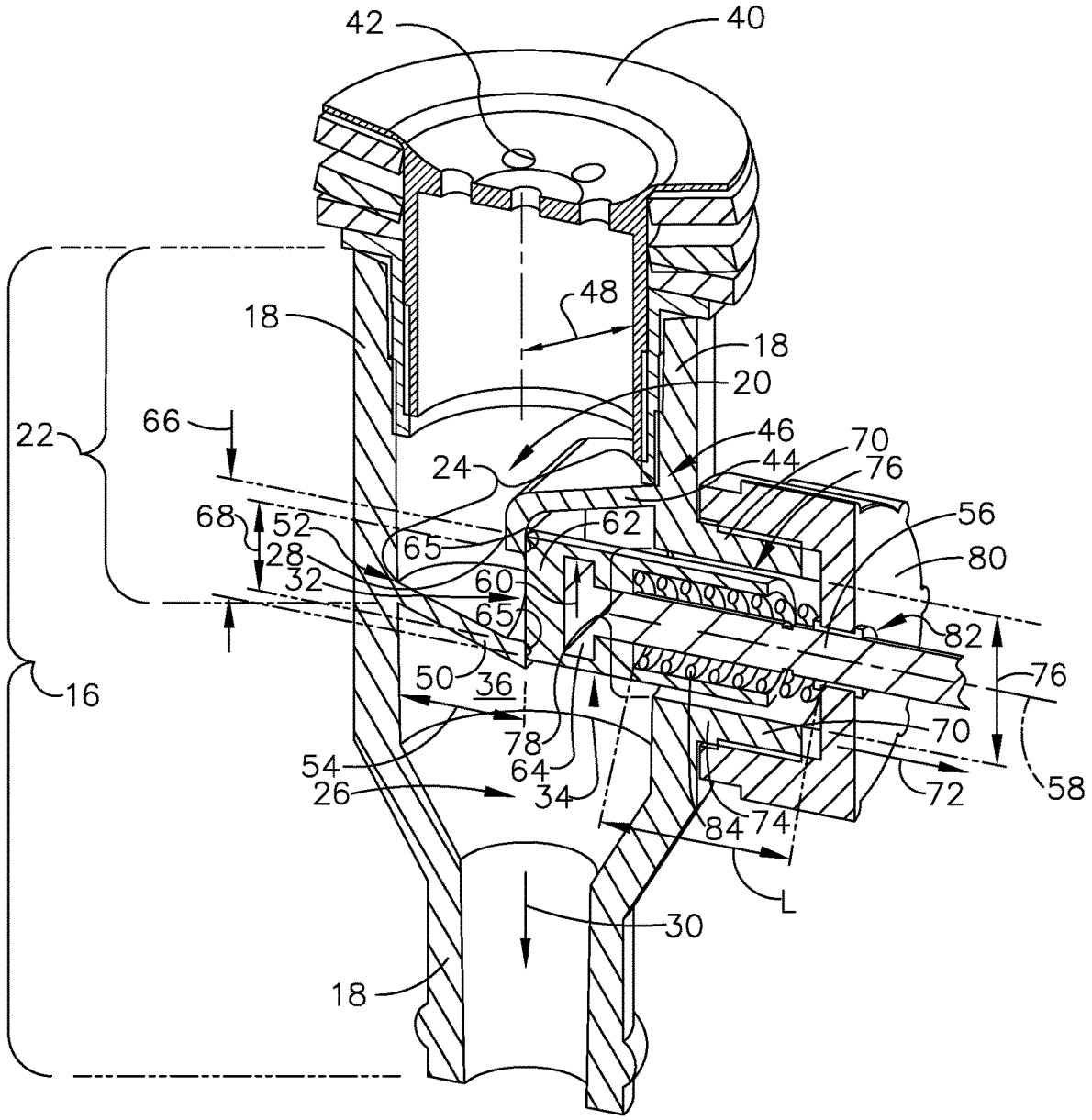
FIG. 6 is a cross section view along line 6-6 in FIG. 5 with plug member of the drain valve assembly in a first position abutting a first portion of a wall formation within the drain.
Figure 7:
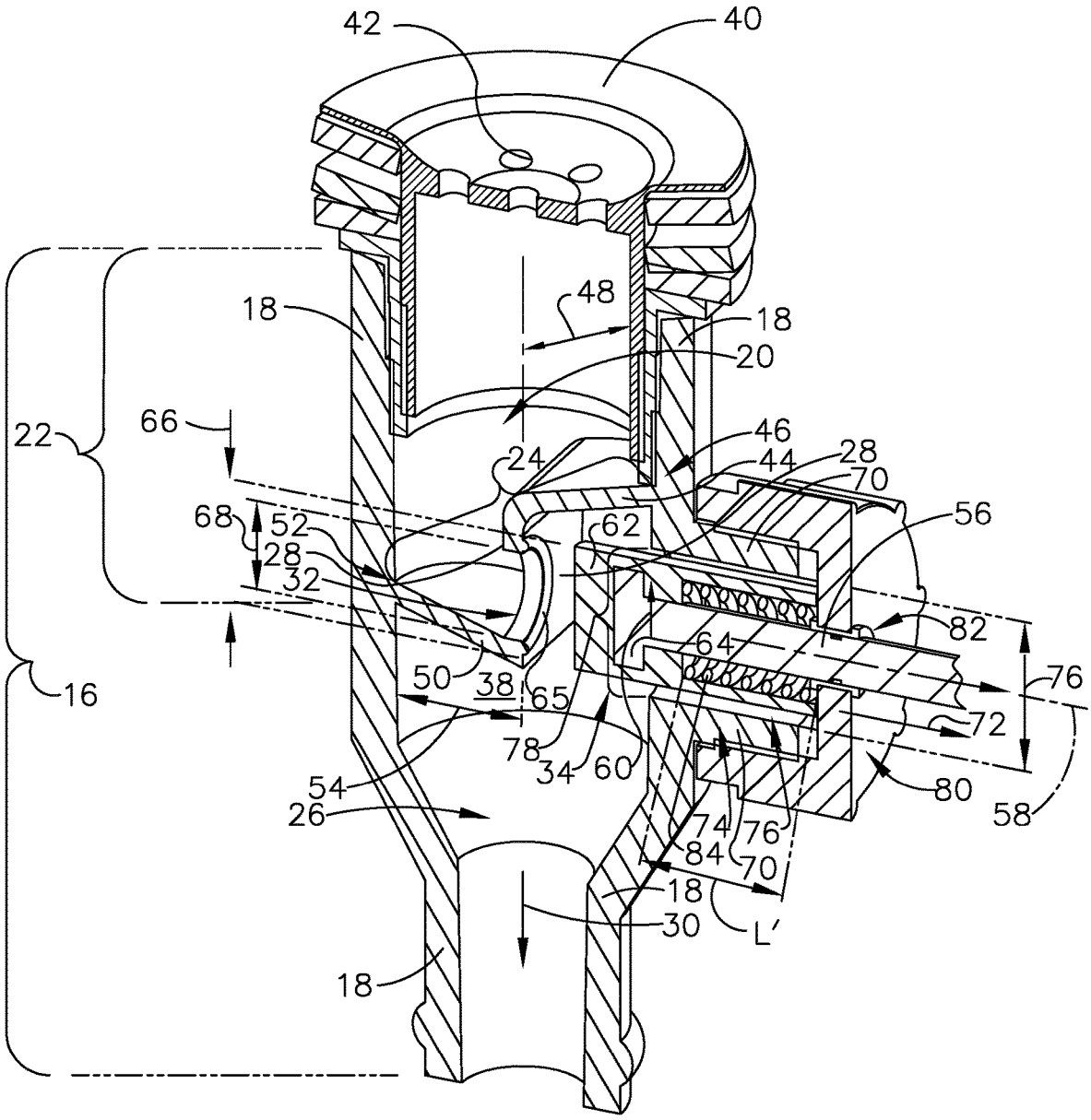
FIG. 7 is a cross section view along line 6-6 in FIG. 5 with plug member of the drain valve assembly in a second position spaced apart from the first portion of the wall formation within the drain.

In referring to FIGS. 1-4, drain valve assembly 10 for basin 12 is shown with faucet assembly 14. Drain valve assembly 10 includes drain 16 having sidewall 18, as seen in FIGS. 6 and 7. Sidewall 18 of drain 16 defines first opening 20 which is in fluid communication with basin 12 and with first portion 22 of drain 16. Fluid communication indicates the structures are configured such that fluid would pass through between the structures, such as for example, fluid would pass from basin 12 to first opening 20 and with respect to first portion 22 of drain 16. Sidewall 18 includes wall formation 24 positioned within drain 16 which extends across first opening 20 separating first portion 22 of drain 16 from second portion 26 of drain 16. First portion 28 of wall formation 24 extends in first direction 30 away from basin 12 and defines outlet opening 32 which extends through first portion 28.

Drain valve assembly 10 further includes plug member 34 aligned with outlet opening 32 and movable from first position 36 with plug member 34 abutting first portion 28 and closing outlet opening 32, as seen in FIG. 6, and to second position 38 wherein plug member 34 is positioned spaced apart from first portion 28 placing outlet opening 32 in an open position, as seen in FIG. 7, providing fluid communication between first portion 22 of drain 16 and second portion 26 of drain 16. Drain valve assembly 10 further includes drain cap 40, which overlies first opening 20, wherein drain cap 40 defines openings 42, which are positioned in fluid communication with basin 12 and with first opening 20 of first portion 22 of drain 16.

As seen in FIG. 6, wall formation 24 includes second portion 44 which extends from sidewall 18 from one side 46 of drain 16 and across first portion 48 of first opening 20 of the drain 16 and connecting to first portion 28 of wall formation 24. In this example, sidewall 18, second portion 44 and first portion 28 is a single piece construction but could alternatively include two or more piece construction. Wall formation 24 includes third portion 50 which extends from a second opposing side 52 of sidewall 18 of drain 16 across second portion 54 of first opening 20 of drain 16 and connecting to first portion 28 of wall formation 24. In this example, sidewall 18, third portion 50 and first portion 28 is a single piece construction but could alternatively include two or more piece construction. Moreover, sidewall 18, second portion 44, first portion 28 and third portion 50 can be a single piece construction of multiple part construction. As seen in FIGS. 6 and 7, second portion 44 of wall formation 24 and third portion 50 of wall formation 24 are spaced apart from one another.

As seen in FIGS. 6 and 7, plug member 34 includes first rod member 56 having central axis 58 aligned with outlet opening 32 of first portion 28 of wall formation 24. First rod member 56 includes projection formation 64 connected to first rod member 56. Projection formation 64 extends in first transverse direction 60 with respect to first rod member 56 wherein projection formation 64 is encapsulated within seal member 62. First portion 28 of wall formation 24 defines projection member 65 which extends about outlet opening 32 and faces plug member 34 such that seal member 62 engages projection member 65 with plug member 34 in first position 36. Seal member 62 has first width dimension 66 which is greater than a second width dimension 68 of outlet opening 32 of first portion 28 of wall formation 24. This configuration of plug member 34 and of first portion 28 of wall formation 24 provides for a reliable closure of outlet opening 32 with plug member 34 in first position 36.

Second portion 70 of sidewall 18 of drain 16 which extends in a second transverse direction 72 from sidewall 18 of drain 16 forming cylindrical formation 74 a second opening 76 formed by cylindrical formation 74 which extends away from sidewall 18 of drain 16. Second opening 76 formed by cylindrical formation 74 is aligned with third opening 78 defined sidewall 18 of second portion 26 of drain 16. First rod member 56 extends through second opening 76 formed by cylindrical formation 74 and first rod member 56 extends away from drain 16. Cap member 80 positioned and releasably secured to cylindrical formation 74 with cap member 80 defining fourth opening 82 with the first rod member 56 extending through fourth opening 82 of cap member 80. In this example, cap member 80 and cylindrical formation 74 have complementary threads (not shown) such that cap member 80 can be twisted on or off of cylindrical formation 74.

Compression spring 84 is positioned between seal member 62 and cap member 80 having length L, such that with plug member 34 in first position 36, as seen in FIG. 6, compression spring 84 applies a force to plug member 34 abutting plug member 34 against first portion 28 of wall formation 24. As seen in FIG. 7, with plug member 34 into second position 38, as seen in FIG. 7, compression spring 84 becomes shorter in length, having length L', thereby storing energy for returning plug member 34 into first position 36. Length L' of compression spring 84 of FIG. 7 is shorter in length than compression spring 84 of FIG. 6.

Figure 1:
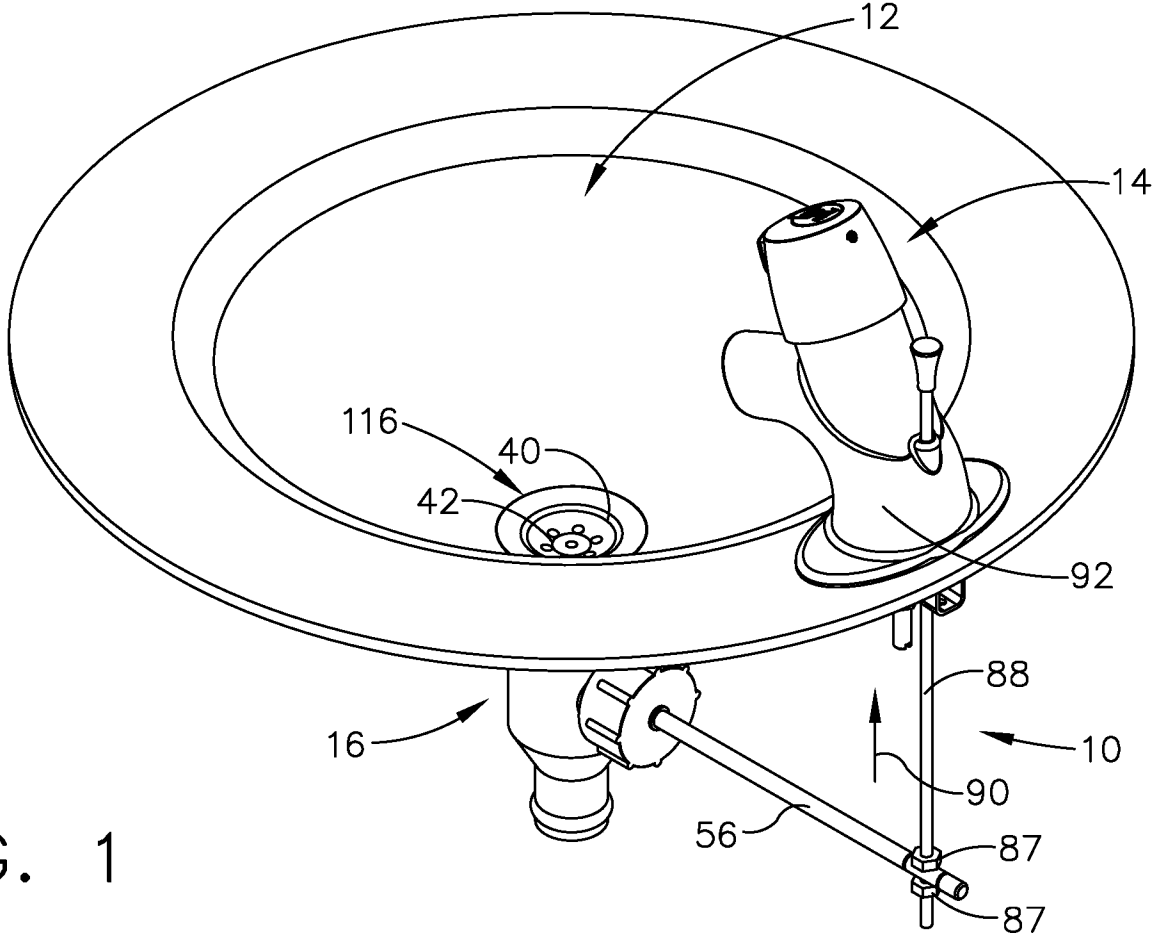
FIG. 1 is a perspective view of a basin with a faucet assembly and a drain valve assembly.
Figure 2:
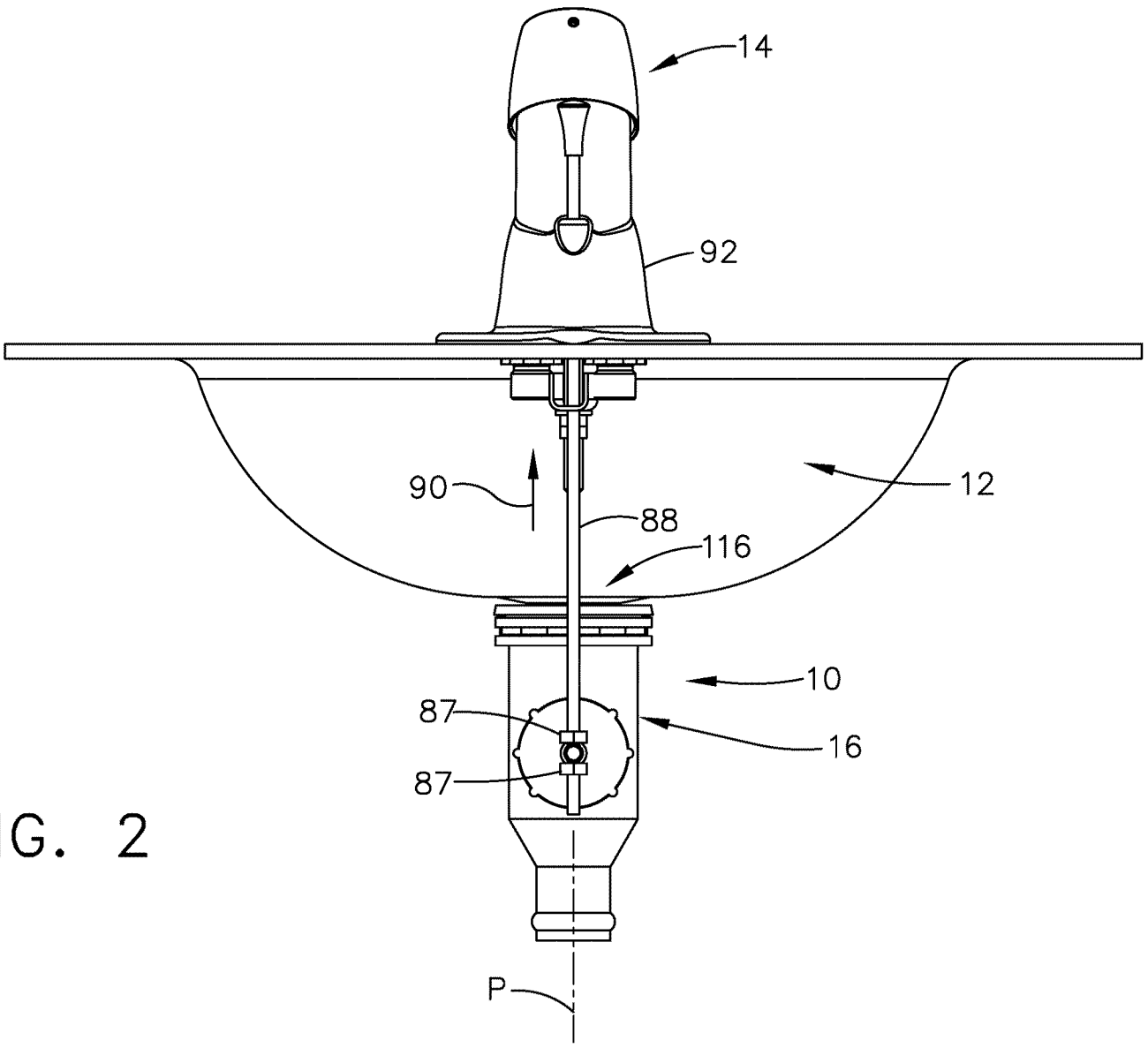
FIG. 2 is a back side plan elevation view of FIG. 1.

First rod member 56 extends through fourth opening 82 formed by cap member 80 and beyond cap member 80 and away from drain 16. First rod member 56 defines fifth opening 86, as seen in FIG. 5, further including second rod member 88, a seen in FIGS. 1-4, positioned within fifth opening 86 defined by first rod member 56 and in this example, passes through fifth opening 86. In this example, first rod member 56 is secured to second rod member 88 with nuts 87 positioned on opposite sides of first rod member 56, wherein nuts 87 engage threads in second rod member 88 (not shown). With second rod member 88 positioned in fifth opening 86 and secured with nuts 87, first and second rod members 56, 88 are positioned in the same plane P, as seen in FIG. 2. With first and second rod members 56, 88 operating in the same plane P, no unwanted torque is applied to this connection between first rod member 56 and second rod member 88 with drain valve assembly 10 in operation, as described below.

Second rod member 88 extends in second direction 90 toward faucet assembly 14 which includes housing 92. Second rod member 88 extends through channel 94, as seen in phantom in FIGS. 3 and 4, defined by housing 92 such that second rod member 88 extends through housing 92. Channel 94 has first end portion 96 which has a third width dimension 98 which is positioned closer to first rod member 56 than second end portion 100 of channel 94 which has a fourth width dimension 102 less than third width dimension 98. The width dimensions in this example extend in direction 104 toward basin 12. This difference is widths between first end portion 96 and second end portion 100 is gradually changed, in this example, along channel 94, from first end portion 96 and second end portion 100.

Figure 3:
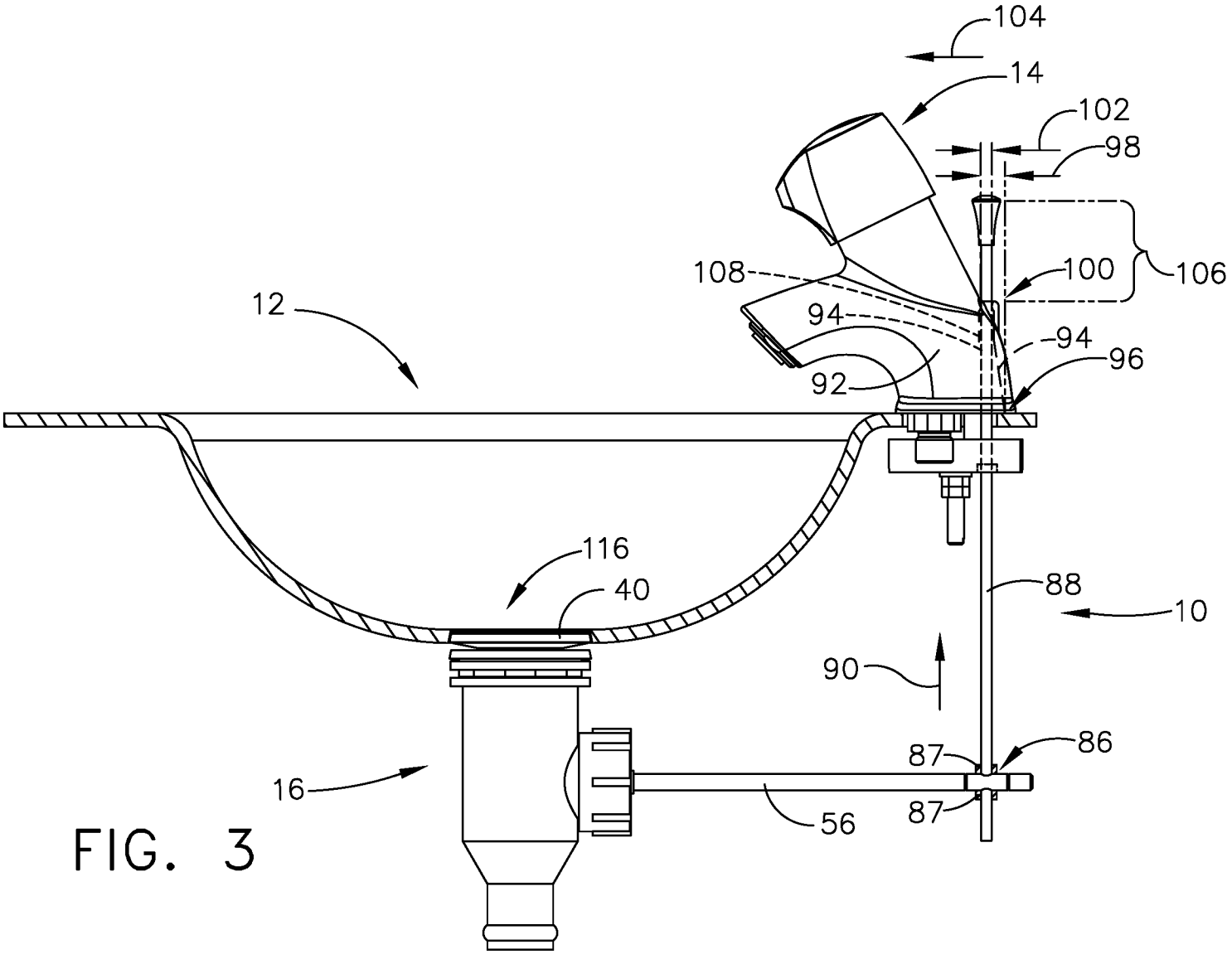
FIG. 3 is a side plan elevation view of FIG. 1 with a portion of the basin partially cut away.
Figure 4:
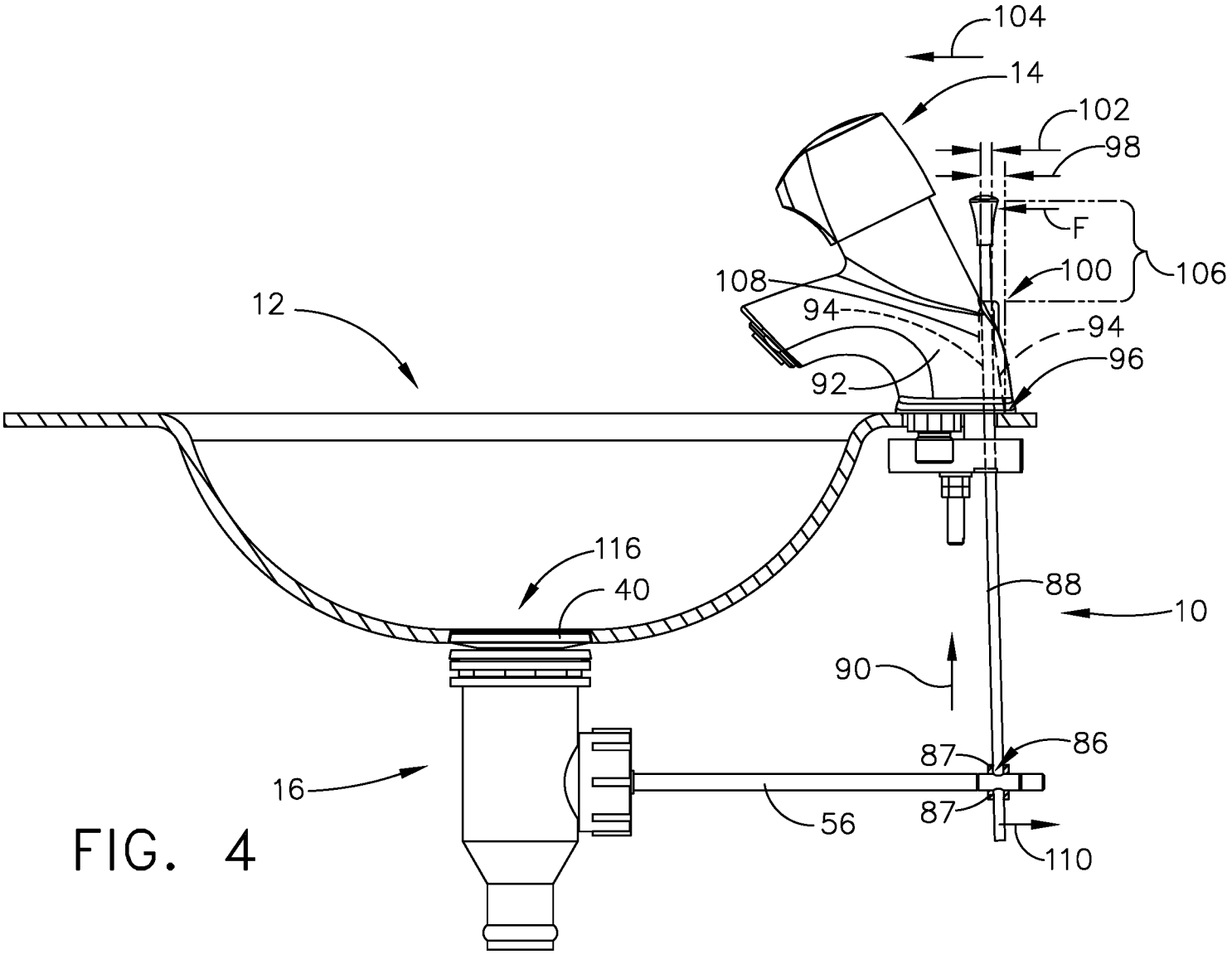
FIG. 4 is the side plan elevation view of FIG. 3 with a force applied to a second rod member, of the drain valve assembly, in a direction toward the basin.
Figure 5:
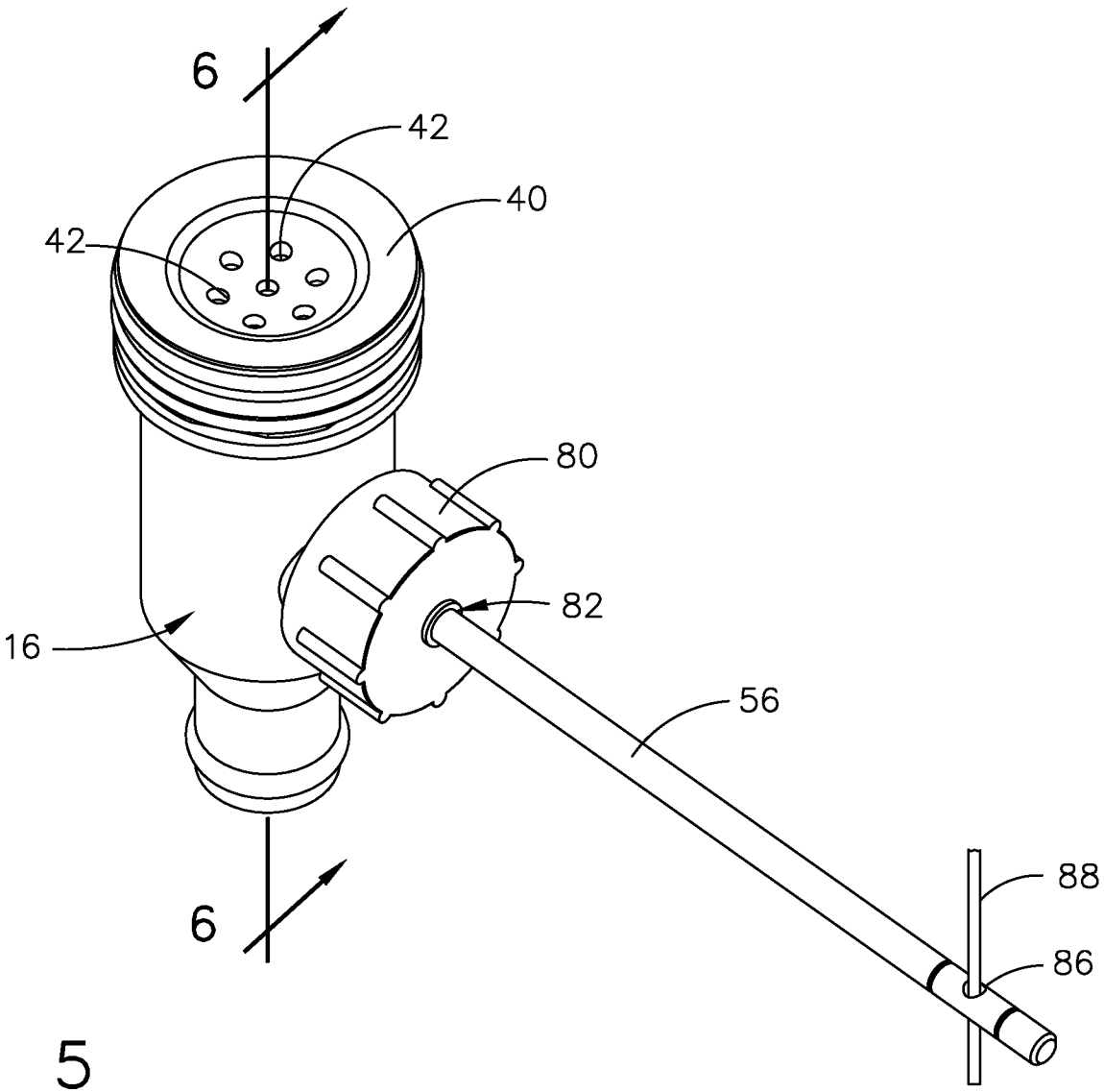
FIG. 5 is an isolated perspective view of the drain and a first rod member for the drain valve assembly and showing a partial view of the second rod member connected to the first rod member.

With portion 106 of second rod member 88, as seen in FIGS. 3 and 4, extending beyond and away from housing 92, force "F" is applied to portion 106 of second rod member 88 moving portion 106 of second rod member 88 in direction 104 toward basin 12. Channel sidewall 108 within channel 94 in contact with second rod member 88 acts as a pivot for second rod member 88 resulting in second rod member 88, which is positioned within fifth opening 86 of first rod member 56, as seen in FIGS. 3-5, moving first rod member 56, as seen in FIG. 4, in direction 110 away from drain 16 and thereby moving plug member 34 from first position 36, as seen in FIG. 6, to second position 38, as seen in FIG. 7. In second position 38, plug member 34 is positioned spaced apart from first portion 28 of wall formation 24 placing outlet opening 32 in an open position. With force "F", as seen in FIG. 4, removed from portion 106 of second rod member 88, compression spring 84 pushes plug member 34 to first position 36, as seen in FIG. 6, closing outlet opening 32 and with moving first rod member 56 toward drain 16.

Figure 8:
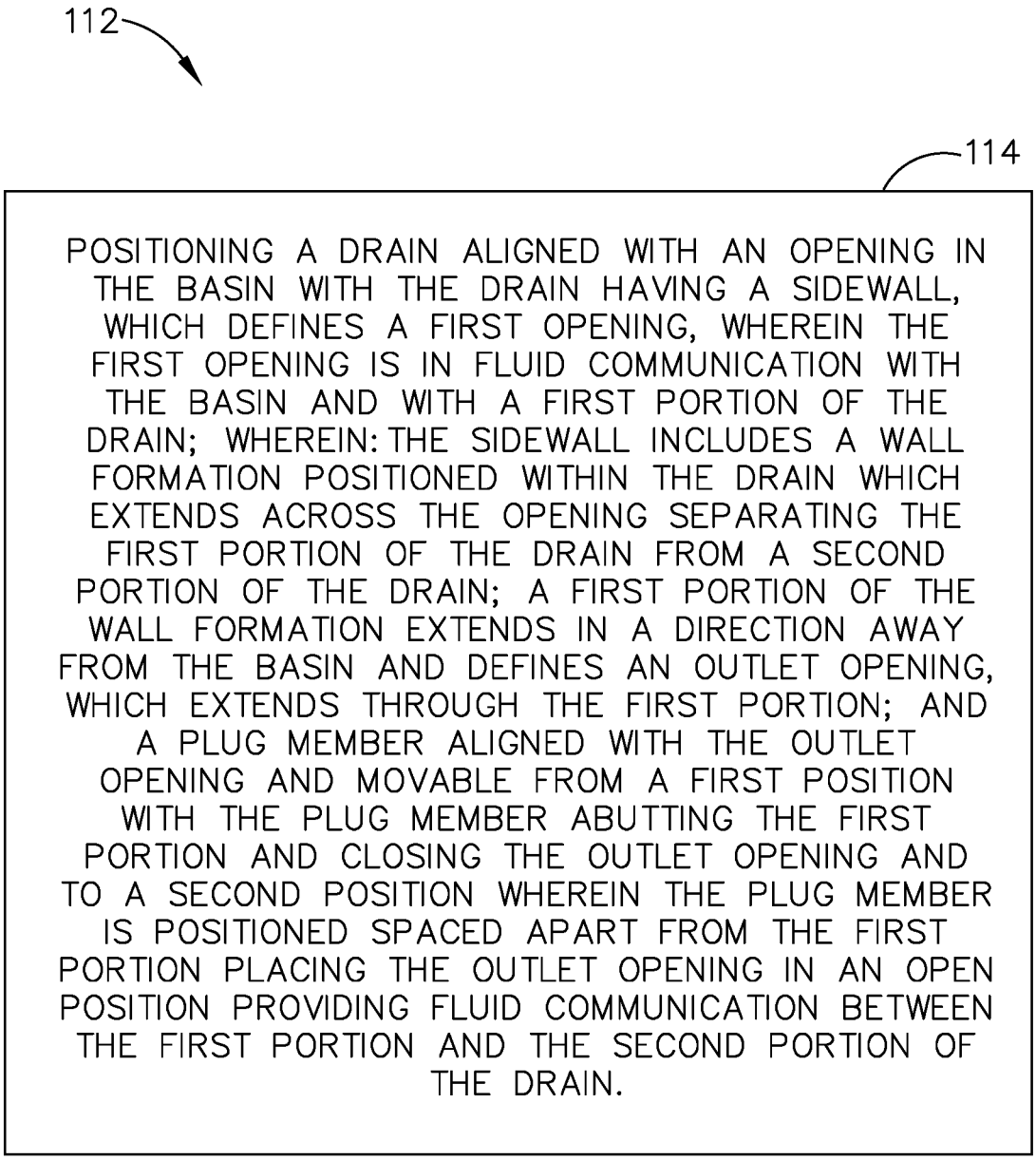
FIG. 8 is a flow chart of a method for operating a drain valve assembly.

In referring to FIG. 8, method 112 for installing a drain valve assembly to a basin is shown. Method 112 includes positioning 114 drain 16 aligned with opening 116 in basin 12, as seen in FIGS. 1-4, with drain 16 having sidewall 18, which defines first opening 20 wherein first opening 20 is in fluid communication with basin 12 and with first portion 22 of drain 16, as seen in FIGS. 6 and 7. Sidewall 18 includes wall formation 24 positioned within drain 16 which extends across first opening 20 separating first portion 22 of drain 16 from second portion 26 of drain 16. First portion 28 of wall formation 24 extends in first direction 30 away from basin 12 and defines outlet opening 32 which extends through first portion 28 of wall formation 24. Plug member 34, aligned with outlet opening 32, and movable from first position 36 with plug member 34 abutting first portion 28 of wall formation 24 and closing outlet opening 32 and to a second position 38 wherein plug member 34 is positioned spaced apart from first portion 28 of wall formation 24 placing outlet opening 32 in an open position providing fluid communication between first portion 22 of drain 16 and second portion 26 of drain 16.

Wall formation 24 includes second portion 44 of wall formation 24, as seen in FIGS. 6 and 7, extending from sidewall 18 from one side 46 of drain 16 and across a first portion 48 of first opening 20 of drain 16 and connecting to first portion 28 of wall formation 24. Third portion 50 of wall formation 24, extending from second opposing side 52 of sidewall 18 of drain 16 and across second portion 54 of first opening 20 of drain 16 and connecting to first portion 28 of wall formation 24. Second portion 44 of wall formation 24 and third portion 50 of wall formation 24 are spaced apart from one another.

First rod member 56 has central axis 58 aligned with outlet opening 32 of first portion 28 of wall formation 24 and includes projection formation 64 connected to first rod member 56. Projection formation 64 extends in first transverse direction 60 to first rod member 56. As described earlier, projection formation 64 is encapsulated within seal member 62. Seal member 62 has first width dimension 66 which is greater than second width dimension 68 of outlet opening 32 of first portion 28 of wall formation 24.

Second portion 70 of sidewall of drain 16, as seen in FIGS. 6 and 7, which extends in second transverse direction 72 from sidewall 18 of drain 16 forming cylindrical formation 74 with second opening 76 formed by cylindrical formation 74 which extends away from sidewall 18 of drain 16. Second opening 76 formed by cylindrical formation 74 is aligned with third opening 78 defined by second portion 26 of drain 16. First rod member 56 extends through third opening 78 formed by cylindrical formation 74 and first rod member 56 extends away from drain 16. Cap member 80 is releasably secured, as earlier described, to cylindrical formation 74 with cap member 80 defining fourth opening 82 with first rod member 56 extending through fourth opening 82 of cap member 80.

Compression spring 84, as earlier described, is positioned between seal member 62 and cap member 80 such that with plug member 34 in first position 36, compression spring 84 applies a force to plug member 34 abutting plug member 34 against first portion 28 of wall formation 24 and with plug member 34 in second position 38, compression spring 84 becomes shorter in length, as earlier described, thereby storing energy for returning plug member 34 to first position 36, as discussed earlier.

While various embodiments have been described above, this disclosure is not intended to be limited thereto. Variations can be made to the disclosed embodiments that are still within the scope of the appended claims.

What is claimed:

1. A drain valve assembly for a basin, comprising:

a drain having a sidewall, which defines a first opening, wherein the first opening is in fluid communication with the basin and with a first portion of the drain; wherein:

the sidewall includes a wall formation positioned within the drain which extends across the first opening separating the first portion of the drain from a second portion of the drain;

a first portion of the wall formation extends in a first direction away from the basin and defines an outlet opening which extends through the first portion of the wall formation in a direction transverse to the first direction; and a plug member aligned with the outlet opening and movable from a first position with the plug member abutting the first portion and closing the outlet opening and to a second position wherein the plug member is positioned spaced apart from the first portion placing the outlet opening in an open position providing fluid communication between the first portion and the second portion of the drain.

2. The drain valve assembly of claim 1, further includes a drain cap, which overlies the first opening, wherein the drain cap defines openings, which are in fluid communication with the basin and with the opening of the first portion of the drain.

3. The drain valve assembly of claim 1, wherein the wall formation includes a second portion which extends from the sidewall from one side of the drain and across a first portion of the first opening of the drain and connecting to the first portion of the wall formation.

4. The drain valve assembly of claim 3, wherein the wall formation includes a third portion which extends from a second opposing side of the sidewall of the drain and across a second portion of the first opening of the drain and connecting to the first portion of the wall formation.

5. The drain valve assembly of claim 4, wherein the second portion of the wall formation and the third portion of the wall formation are spaced apart from one another.

6. The drain valve assembly of claim 1, wherein the plug member includes a first rod member having a central axis aligned with the outlet opening of the first portion of the wall formation.

7. The drain valve assembly of claim 6, wherein the first rod member includes a projection formation connected to the first rod member.

8. The drain valve assembly of claim 7, wherein the projection formation extends in a first transverse direction with respect to the first rod member.

9. The drain valve assembly of claim 8, wherein the projection formation is encapsulated within a seal member.

10. The drain valve assembly of claim 9, wherein the first portion of the wall formation defines a projection member which extends about the outlet opening and faces the plug member such that seal member engages the projection member with the plug member in the first position.

11. The drain valve assembly of claim 9, wherein the seal member has a first width dimension which is greater than a second width dimension of the outlet opening of the first portion of the wall formation.

12. The drain valve assembly of claim 9, further includes:

a second portion of the sidewall of the drain which extends in a second transverse direction from the sidewall of the drain forming a cylindrical formation with a second opening formed by the cylindrical formation which extends away from the sidewall of the drain;

the second opening formed by the cylindrical formation is aligned with a third opening defined by sidewall of the second portion of the drain; the first rod member extends through the second opening formed by the cylindrical formation and the first rod member extends away from the drain;

a cap member positioned and releasably secured to the cylindrical formation with the cap member defining a fourth opening, with the first rod member extending through the fourth opening of the cap member; and a compression spring positioned between the seal member and the cap member such that with the plug member in the first position, the compression spring applies a force to the plug member abutting the plug member against the first portion of the wall formation and with the plug member in the second position, the compression spring becomes shorter in length thereby storing energy for returning the plug member into the first position.

13. The drain valve assembly of claim 12, wherein with the first rod member extending through the fourth opening formed by the cap member and beyond the cap member and away from the drain, the first rod member defines a fifth opening further including a second rod member positioned within the fifth opening defined by the first rod member and the second rod member extends in a second direction toward a faucet assembly which includes a housing.

14. The drain valve assembly of claim 13, wherein:

the second rod member extends through a channel defined by the housing such that the second rod member extends through the housing; and the channel has a first end portion which has a third width dimension which is positioned closer to the first rod member than a second end portion of the channel which has a fourth width dimension less than the third width dimension.

15. The drain valve assembly of claim 14, wherein:

with a portion of the second rod member, which extends beyond and away from the housing having a force applied to the portion of the second rod member moving the portion of the second rod member in a direction toward the basin, a channel sidewall within the channel contacts the second rod member resulting in the second rod member, which is positioned within the fifth opening of the first rod member, moving the first rod member in a direction away from the drain and moving the plug member to the second position wherein the plug member is positioned spaced apart from the first portion of the wall formation placing the outlet opening in an open position; and with the force removed from the portion of the second rod member, the compression spring pushes the plug member to the first position closing the outlet opening and moving the first rod member toward the drain.

16. A method for installing a drain valve assembly to a basin, comprising:

positioning a drain aligned with an opening in the basin with the drain having a sidewall, which defines a first opening, wherein the first opening is in fluid communication with the basin and with a first portion of the drain; wherein:

the sidewall includes a wall formation positioned within the drain which extends across the first opening separating the first portion of the drain from a second portion of the drain;

a first portion of the wall formation extends in a first direction away from the basin and defines an outlet opening which extends through the first portion of the wall formation in a direction transverse to the first direction; and a plug member aligned with the outlet opening and movable from a first position with the plug member abutting the first portion and closing the outlet opening and to a second position wherein the plug member is positioned spaced apart from the first portion placing the outlet opening in an open position providing fluid communication between the first portion and the second portion of the drain.

17. The method of claim 16, wherein the wall formation further includes:

a second portion extending from the sidewall from one side of the drain and across a first portion of the first opening of the drain and connecting to the first portion;

a third portion extending from a second opposing side of the sidewall of the drain and across a second portion of the first opening of the drain and connecting to the first portion; and the second portion of the wall formation and the third portion of the wall formation are spaced apart from one another.

18. The method of claim 16, wherein the plug member further includes:

a first rod member having a central axis aligned with the outlet opening of the first portion of the wall formation;

the first rod member includes a projection formation connected to the first rod member;

the projection formation extends in a first transverse direction to the first rod member; and the projection formation is encapsulated within a seal member.

19. The method of claim 18, wherein the seal member has a first width dimension which is greater than a second width dimension of the outlet opening of the first portion of the wall formation.

20. The method of claim 19, wherein:

a second portion of the sidewall of the drain which extends in a transverse direction from the sidewall of the drain forming a cylindrical formation with a second opening formed by the cylindrical formation which extends away from the sidewall of the drain;

the second opening formed by the cylindrical formation is aligned with a third opening defined by sidewall of the second portion of the drain; the first rod member extends through the second opening formed by the cylindrical formation and the first rod member extends away from the drain;

a cap member releasably secured to the cylindrical formation with the cap member defining a fourth opening with the first rod member extending through the fourth opening of the cap member; and a compression spring positioned between the seal member and the cap member such that with the plug member in the first position, the compression spring applies a force to the plug member abutting the plug member against the first portion of the wall formation and with the plug member in the second position, the compression spring becomes shorter in length thereby storing energy for returning the plug member to the first position.

* * * * *